US007575181B2

(12) United States Patent
Weemhoff

(10) Patent No.: US 7,575,181 B2
(45) Date of Patent: Aug. 18, 2009

(54) ARTIFICIAL WATERFALL ECHO CHAMBER

(75) Inventor: Jeffrey G. Weemhoff, Chagrin Falls, OH (US)

(73) Assignee: Meridienne International, Inc., Mantua, OH (US)

( * ) Notice: Subject to any disclaimer, the term of this patent is extended or adjusted under 35 U.S.C. 154(b) by 158 days.

(21) Appl. No.: 11/643,384

(22) Filed: Dec. 21, 2006

(65) Prior Publication Data

US 2007/0138314 A1 Jun. 21, 2007

Related U.S. Application Data

(60) Provisional application No. 60/752,500, filed on Dec. 21, 2005.

(51) Int. Cl.
*B05B 17/08* (2006.01)

(52) U.S. Cl. ..... 239/17; 239/211; 239/16; 239/20; 220/507; 206/497

(58) Field of Classification Search ..... 239/16, 239/17, 18, 28, 29.3, 211; 220/567.1, 507, 220/505, 618, 617, 600, 480, 481, 578, 561; 206/497

See application file for complete search history.

(56) References Cited

U.S. PATENT DOCUMENTS 3,447,715 A * 6/1969 Beney ..... 206/507
4,836,142 A 6/1989 Duback
5,163,587 A * 11/1992 Apps et al. ..... 222/105
5,167,368 A 12/1992 Nash
5,226,935 A * 7/1993 Wolff et al. ..... 96/262
5,584,991 A 12/1996 Wittstock
5,912,033 A * 6/1999 Ferguson ..... 426/124
5,967,322 A * 10/1999 Apps et al. ..... 206/497
6,042,724 A 3/2000 Gutberlet
6,290,844 B1 * 9/2001 Tennyson, Jr. ..... 210/170.06
6,382,520 B1 5/2002 Hones
6,405,937 B1 * 6/2002 Stukenberg ..... 239/12
6,527,257 B1 3/2003 Schuld
6,581,349 B1 * 6/2003 Riley ..... 52/454
6,695,221 B2 * 2/2004 Lussier ..... 239/17
6,843,910 B1 * 1/2005 Thomas ..... 210/167.01
6,849,031 B2 2/2005 Paci
6,874,698 B1 4/2005 Stukenberg
6,883,722 B2 4/2005 Pankow
6,913,204 B1 7/2005 Bradford
D549,454 S * 8/2007 Åhman ..... D3/304
D554,371 S * 11/2007 Åhman ..... D3/304

(Continued)

*Primary Examiner*—Len Tran
*Assistant Examiner*—Trevor E McGraw
(74) *Attorney, Agent, or Firm*—John F. Letchford; Archer & Greiner, P.C.

(57) ABSTRACT

An echo chamber including a high-strength, structurally rigid receptacle and a weight bearing grate through which the water from an artificial outdoor waterfall may pass, which grate can support considerable weight loads exerted by materials such as rocks, stones, and the like. The receptacle functions as a substitute for a flexible artificial waterfall water sump liner and receives recirculating water of an artificial waterfall. When constructing a disappearing artificial waterfall using a chamber constructed according to the present invention, rocks or other material are placed on the chamber's grate. As water cascades through the material on the grate and falls into the chamber, an echo sound is generated. Differing configurations of the stones on the grate and changes in water level in the receptacle produce echoes of different pitch and intensity.

9 Claims, 3 Drawing Sheets

U.S. PATENT DOCUMENTS

| | | | | |
|---|---|---|---|---|
| 7,341,203 | B1 * | 3/2008 | Yeomans et al. | 239/20 |
| 2005/0155144 | A1 | 7/2005 | McDonald | |
| 2005/0167347 | A1 * | 8/2005 | Thomas | 210/170 |
| 2005/0223490 | A1 | 10/2005 | Kunkel | |
| 2005/0235407 | A1 | 10/2005 | Kunkel | |

* cited by examiner

ARTIFICIAL WATERFALL ECHO CHAMBER

CROSS REFERENCE TO RELATED APPLICATION

The present application claims the benefit of U.S. Provisional Patent Application No. 60/752,500, filed Dec. 21, 2005, which is incorporated herein by reference in its entirety.

FIELD OF THE INVENTION

The present invention relates in general to artificial waterfalls and in particular to a water sump suitable for producing desirable acoustic effects in high water volume, typically outdoor artificial waterfalls.

BACKGROUND OF THE INVENTION

Indoor and outdoor waterfalls, with or without associated ponds, come in a variety of sizes and constructions.

For example, U.S. Pat. Nos. 6,883,722; 6,527,257 and 6,382,250 disclose indoor waterfalls ranging from tabletop to wall-sized apparatus.

U.S. Pat. No. 5,226,935 describes a waterfall-type indoor room humidifier having a perforated plate through which water passes from a cascading flow into a reservoir. The perforated plate is not described as being capable of supporting large stones of the kinds typically used in outdoor artificial waterfall installations.

U.S. Pat. No. 6,695,221 describes an indoor waterfall system including a remote water supply reservoir which includes a pump for pumping water to an upper distribution basin from which water is discharged onto an interim basin. The interim basin may be installed flush with or surface mounted to a floor surface. The interim basin is covered by an acoustical grille. The acoustical grille is not described as being capable of supporting large stones of the kinds typically used in outdoor artificial waterfall installations. Moreover, the acoustical grille is designed eliminate echo that may be produced by water falling into the water supply sump or reservoir.

U.S. Pat. No. 4,836,142 describes a multiple-tiered aquarium and waterfall system in which screens are provided at the tops of each of each aquarium. The screens allow water flow therethrough while reducing turbulence associated with the cascading water and retaining fish in the respective aquariums. The aquarium and waterfall system is not disclosed as being useful for outdoor applications. And, the screens are not described as being capable of supporting large stones of the kinds typically used in outdoor artificial waterfall installations.

U.S. Pat. No. 6,849,031 describes an artificial rock climbing wall incorporating a waterfall. The structure is bolted to a concrete substrate and includes a surface mounted water reservoir made from molded fiberglass. The reservoir is covered by a fiberglass grating supported by an I-beam. The artificial rock climbing wall is designed for use in amusement parks, water parks, fairs, and sporting or other outdoor events that appeal to sport and climbing enthusiasts. Such places and events are typically quite noisy. Not surprisingly, therefore, U.S. Pat. No. 6,849,031 does not disclose any structure for producing desirable acoustic effects.

U.S. Pat. No. 6,913,204 describes an artificial waterfall for use with a swimming pool or an ornamental pond. It does not describe any structure for producing desirable acoustic effects.

U.S. Pat. No. 5,167,368 discloses an artificial indoor or outdoor waterfall having various structural features for producing the acoustical effect of a natural waterfall. However, the waterfall possesses no structure for supporting stones which are a popular aesthetic feature commonly used in artificial ponds.

U.S. Pat. No. 5,584,991 and published U.S. Patent Application No. 2005/0167347 illustrate outdoor artificial ponds having associated artificial waterfalls. Neither of those publications describe any structure for producing desirable acoustic waterfall effects of any kind. In typical artificial outdoor ponds such as those taught by U.S. Pat. No. 5,584,991 and published U.S. Patent Application No. 2005/0167347 a hole of desired size, shape and depth is dug into the ground and the hole is lined with a flexible, water-impervious sump liner. A pump and piping are installed to draw water from the sump to the pump and to return water from the pump to the sump. An artificial waterfall may or may not be installed in the pump-to-sump water flow line. Stones or rocks are placed in the sump for decorative purposes and to hold the sump liner in place. The number of stones needed for the installation may be considerable if the pond owner desires to have rocks visible at the surface of the pond. The sump is then filled to a desired level with water and the water circulation is system is activated to operate the artificial pond.

Because of its supple nature, a flexible sump liner cannot be used above ground or placed in a recess or crevice provided in a side hill of an artificial waterfall landscape. In addition, the typical flexible sump liner pond construction involves considerable costs in terms of labor, materials and maintenance. More specifically, substantial time and expense is involved in digging the hole to accommodate the liner, placing the liner and stones, and installing and maintaining the plumbing necessary to operate the pond and associated waterfall (if present).

An advantage exist, therefore, for a chamber including a structurally rigid receptacle that can function as a substitute for a flexible sump liner for receiving the water of an artificial outdoor waterfall, whereby the receptacle may be easily installed in-ground, above ground or placed in a recess or crevice provided in a side hill of the waterfall.

A further advantage exists for a chamber including a structurally rigid receptacle and a high-strength grate through which the water from an artificial outdoor waterfall may pass, which grate can support considerable weight loads exerted by rocks, stones, and the like.

A further advantage exists for a chamber that is capable of generating an acoustically pleasing echo sound as water from an artificial outdoor waterfall enters the chamber.

SUMMARY OF THE INVENTION

The present invention provides a chamber including a high-strength, structurally rigid, tub-like water sump receptacle and a high-strength, weight bearing grate through which the water from an artificial outdoor waterfall may pass, which grate can support considerable weight loads exerted by material such as rocks, stones, and the like. The receptacle is preferably formed from high-strength plastic and the grate may be formed from high strength plastic or corrosion-resistant metal. The receptacle functions as a substitute for a flexible artificial waterfall water sump liner and receives recirculating water of a large-scale, typically outdoor, "disappearing artificial waterfall." As used herein, the phrase "disappearing artificial waterfall" means an artificial waterfall comprised of a sump which acts as a water reservoir, and recirculating plumbing including a pump and piping for drawing water from the sump and raising it to a higher elevation from which it is discharged and returned by gravity to the sump.

When constructing a disappearing artificial waterfall using a chamber constructed according to the present invention, the chamber is placed at a desired location and appropriate recirculating plumbing is installed. Lastly, rocks are placed on the chamber's grate. Upon operation of the waterfall, as water cascades through the rocks on the grate and falls into the chamber, an echo sound is generated un the chamber. Differing configurations of the stones on the grate and changes in water level in the receptacle can produce echoes of different pitch and intensity. The sounds generated by the echo chamber add an acoustically pleasing dimension to the natural aesthetic attraction of the falling water. In addition to the pleasing sound effects, the "echo chamber" according to the invention is designed to provide the installer and end user with several important advantages over current methods for building disappearing water features:

- Self-supporting receptacle allows easy installation above ground, in-ground or into a crevice in a side hill of an artificial waterfall landscape.
- Eliminates the need for a liner, as well as a pump vault and pipe extensions that are external of the sump.
- Significantly reduces the amount of rocks needed to complete the installation.
- Improves pump access and pump maintenance.
- Faster installation results in lower labor costs.
- Chamber receptacle holds significantly more water than many existing artificial waterfall sumps, thereby reducing the frequency at which water must be added to the system to replace water lost by evaporation, maintenance or other reasons.
- Allows for easy installation of multiple pumps, waterfalls or streams.
- Easily plumbed with an overflow drain to protect expensive landscaping.
- Easily plumbed with an automatic water leveler.
- Easily plumbed with a bottom drain for easy clean out of dirty water and sludge build up.
- Chamber can be fitted with lighting fixtures to illuminate splashing water to enhance evening and night aesthetics.

Other details, objects and advantages of the present invention will become apparent as the following description of the presently preferred embodiments and presently preferred methods of practicing the invention proceeds.

BRIEF DESCRIPTION OF THE DRAWINGS

The invention will become more readily apparent from the following description of preferred embodiments thereof shown, by way of example only, in the accompanying drawings wherein.

DETAILED DESCRIPTION OF THE INVENTION

Figure 1:
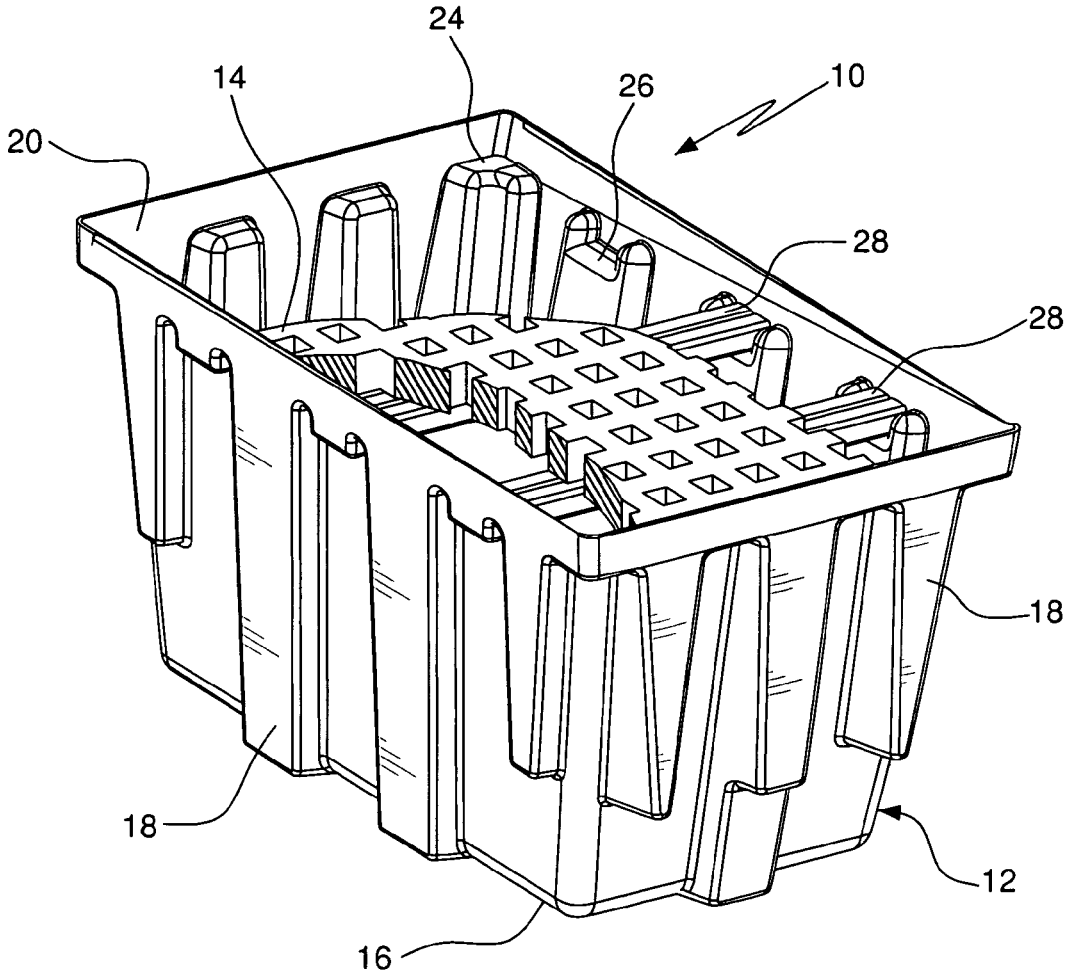
FIG. 1 is a perspective view of an artificial waterfall echo chamber constructed in accordance with the present invention with certain elements omitted for clarity of illustration.

Referring to the drawings wherein like or similar references indicate like or similar elements throughout the several views, there is shown in FIG. 1 an echo chamber 10 according to the present invention that is adapted for use in a disappearing waterfall. Chamber 10 comprises a receptacle 12 and grate means 14. Preferably, although not necessarily, grate means 14 is not a single grate, but a plurality of grate members or planks that together cover the open top of receptacle 12.

Figure 2:
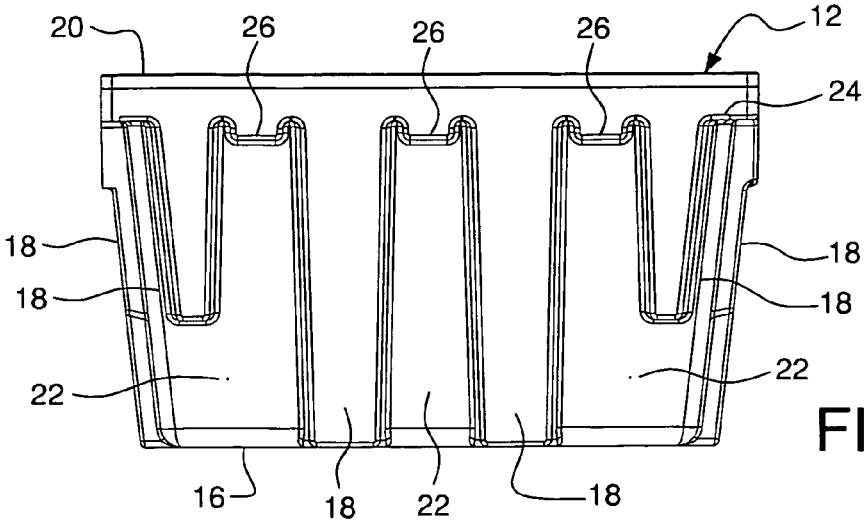
FIG. 2 is a side view of a water sump receptacle component of the echo chamber of FIG. 1.
Figure 3:
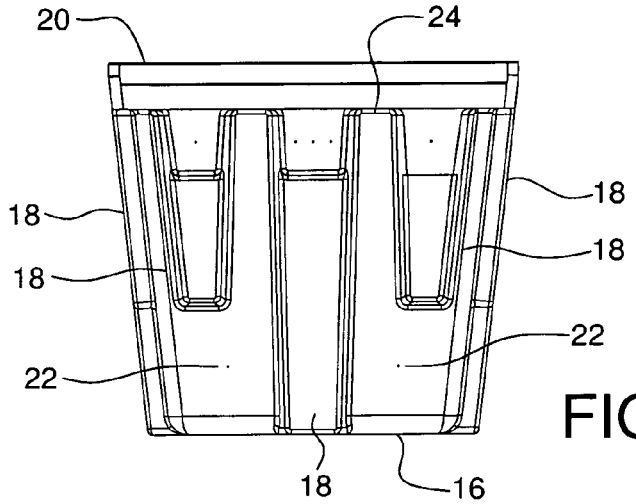
FIG. 3 is end view of the water sump receptacle of FIG. 2.
Figure 4:
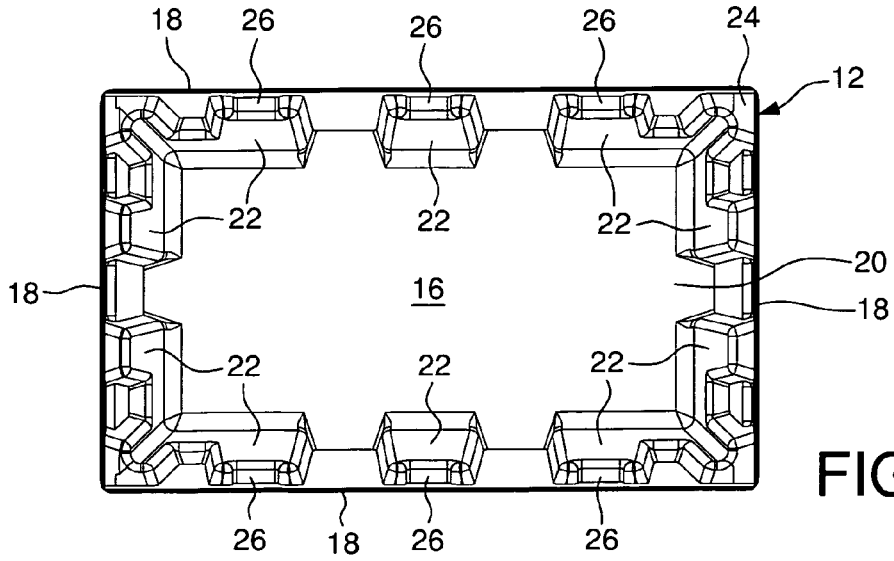
FIG. 4 is top plan view of the water sump receptacle of FIG. 2.

Referring to FIGS. 2-4, there is provided an exemplary although non-limitative embodiment of receptacle 12. Receptacle 12 is preferably a high-strength, substantially rigid, tub-like receptacle. As discussed in connection with FIG. 5, receptacle 12 functions as a water sump for an artificial waterfall. As used herein, the term "substantially rigid" with respect to the receptacle means the receptacle is essentially rigid and self-supporting but may be subject to nominal flexure as might be expected when the receptacle is filled with water (potentially some several hundred gallons of water) and bearing the weight of the grate means, described below, and any material such as rocks or stones that may be supported by the grate means. Receptacle 12 may be formed from any suitable high strength, corrosion-resistant material such as plastic or corrosion-resistant metal. A presently preferred material useful for forming receptacle 12 is approximately 150-500 mil thick HMWPE (high molecular weight polyethylene, a/k/a HDPE (high density polyethylene)). Other suitable materials may include, for example, fiberglass, galvanized steel, stainless steel, or the like.

Receptacle 12 includes a bottom 16, side wall means 18 contiguous with bottom 16, and an open top 20. According to a presently preferred but non-limitative embodiment, receptacle 12 is generally rectangular in shape. However, the number and arrangement of the side wall surfaces that comprise side wall means 18 may range from as few as one, in the case of circular or ellipsoid receptacles, to as many as may be desired or necessary for a particular end user installation. That is, receptacle 12 may assume any shape such as, for example, circular, ellipsoid, square other polygonal shape, or any combination and number of linear and curvilinear side wall surfaces to define the desired shape. Notwithstanding the outer shape of the receptacle, it must be constructed in such a manner as to produce an audible echo sound effect when water from a disappearing artificial waterfall enters open top 20 and contacts water contained in the receptacle. By way of example, it has been observed that a desirable echo effect is achieved in a generally rectangular receptacle having a length of approximately 4 feet, a width of from about 2 to about 3 feet and a depth or height of from about 2 to about 3 feet. As a further example, a desirable echo effect has also been observed in a generally rectangular receptacle having a length of approximately 9 feet, a width of approximately 5 feet and a depth or height of from about 2 to about 3 feet.

In order to enhance the rigidity of receptacle 12, side wall means 18 may include structural reinforcement means 22. Preferably, although not necessarily, the structural reinforcement means comprise inwardly projecting protrusions formed in side wall means 18 at the time of manufacture of the receptacle. However, the structural reinforcement means may be ribs, gussets or similar reinforcement members that may be attached to the inner and/or outer surfaces of side wall means 18 subsequent to manufacture of the receptacle.

Receptacle 12 may also include means 24 for supporting grate means 14. Such grate supporting means may be the upper edge or rim of the side wall means 18 that defines open top 20. Alternatively, the grate supporting means may be shoulder or ledge means formed internally of side wall means 18. According to a preferred embodiment, the structural reinforcement means 22 extend for less than the entire height of side wall means 18 to establish shoulder or ledge means 24 atop which grate means 14 may rest (FIG. 1). Additionally, as seen in FIG. 1, receptacle 12 may include means for accommodating support beams or members for providing additional weight bearing support for grate means 14. In a presently preferred embodiment, such support beam accommodating means comprise notches or recesses 26 provided in upper ends of structural reinforcement means 22. Recesses 26 are adapted to receive opposite ends of support beams or members 28 (some of which are seen in FIG. 1) that may be integral with or separate from grate means 14. Support beams or members 28 may be formed integrally with grate means 14 or may be separate therefrom and may be fabricated from any suitable essentially rigid, bending resistant material.

According to the invention, grate means 14 is a weight bearing member and is preferably removably connected to receptacle 12. As used herein, the term "weight bearing" with respect to the grate means 14 shall be understood to mean that the grate means does not merely function as a debris strainer or filtering device but instead is capable of and intended to support considerable weight (e.g., from at least about 50 pounds for smaller receptacles to as much as several thousand pounds larger receptacles).

Grate means 14 may assume many possible configurations, constructions and materials. The instant disclosure offers two different, although non-limitative, grate designs. The first is a two-piece system, constructed of HDPE. Preferably, it is cut from a sheet of solid. approximately 400 mil thick HDPE. The exact pattern of perforations is at the discretion of the manufacturer and/or end user. For this particular design, the slat members or supports 28 are preferably made of polyvinyl chloride ("PVC") The PVC support tubes are desirably extruded 1.5 inch square PVC with about 60-100 mil wall thickness. They may be cut to length at the manufacturing facility or on site. The supports 26 may be integral with or separate from grate means 14.

According to another embodiment, grate means 14 may be fabricated from corrosion-resistant steel or other corrosion-resistant metal. In a presently preferred embodiment, the grate means 14 are constructed as planks of 18-gauge stamped, bent and galvanized steel Grate-Lock™, corrosion-resistant planks that are marketed by the McNichols Company of Tampa, Fla. When used with the aforementioned smaller receptacle, the planks measure about 9 inches wide, about 44.5 inches long and about 2.5 inches thick/deep and have approximately 43% open area when connected to one another. For a "smaller size" receptacle, two female/male planks and one male/male plank may be used. As with receptacle 12, other suitable materials for the grate means 14 may include, for example, fiberglass, stainless steel, or the like. It will also be understood that the size and material chosen for grate means 14 may vary depending on the size of receptacle and the intended end use of chamber 10.

Figure 5:
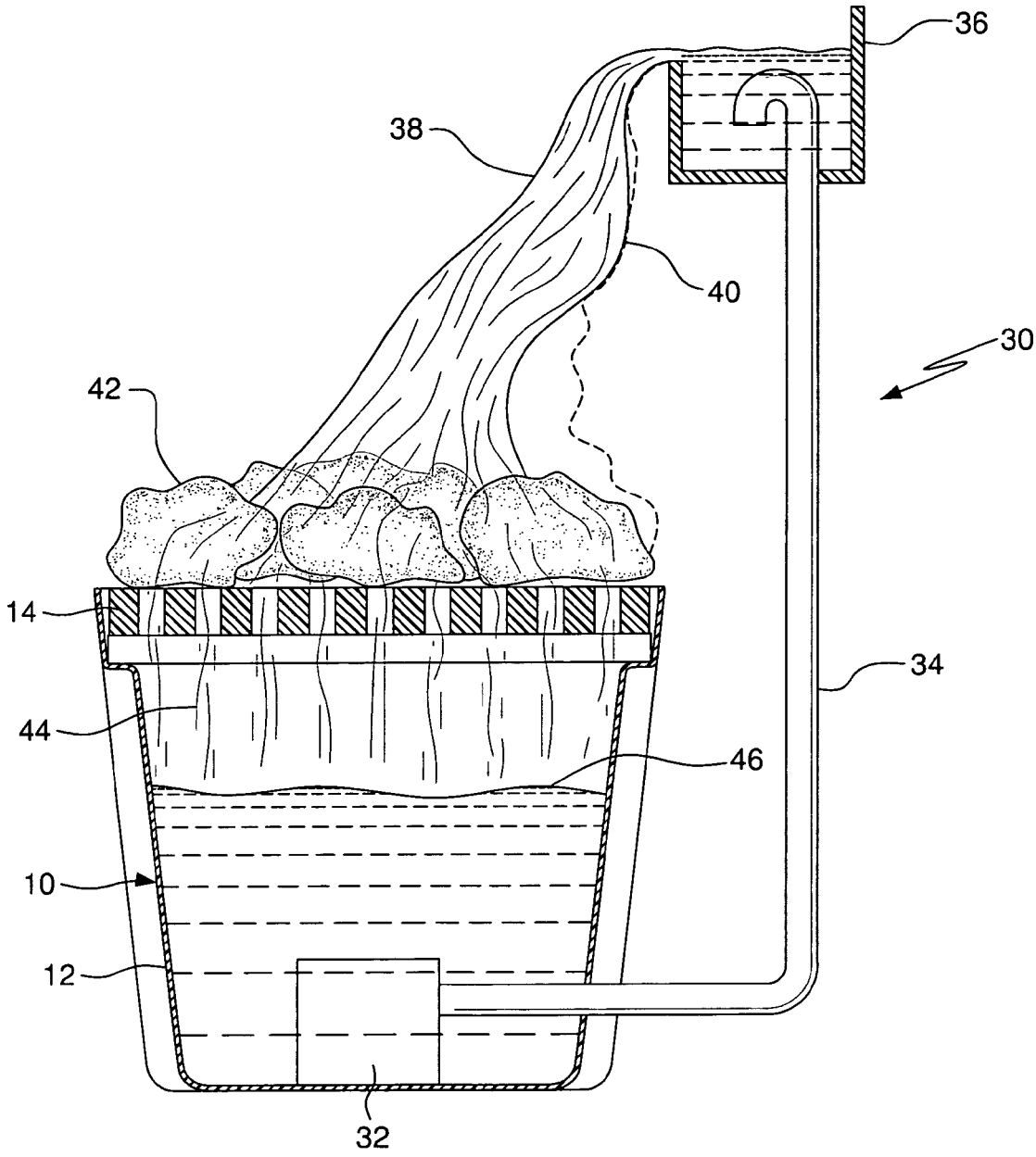
FIG. 5 is a schematic side elevation and cross-section view of an artificial waterfall including an artificial waterfall echo chamber constructed in accordance with the present invention.

FIG. 5 schematically reflects a disappearing artificial waterfall 30 incorporating an echo chamber 10 according to the present invention. In addition to chamber 10, waterfall 30 includes a pump 32 that pumps water upwardly through piping 34 to an optional reservoir 36 from which a stream of water 38 flows over the outer surface of a natural and/or artificial facade (represented by dashed line 40). As the water stream cascades over facade 40, it impacts material such as, for example, rocks or stones 42, the sizes, number and arrangement of which are placed atop grate means 14 at the discretion of the end user.

As noted above, as water cascades through the rocks or other material 42 on the grate means and falls into the chamber (as indicated by reference numeral 44), an echo sound is generated. Differing configurations of the stones on the grate and changes in water level 46 in the receptacle produce echoes of different pitch and intensity. The sounds generated by the echo chamber add an acoustically pleasing dimension to the natural aesthetic attraction of the falling water as well as the many installer and end user advantages noted above.

Further, echo chambers 10 according to the invention are modular and may be arranged and connected in any desired number and formation so as to produce artificial waterfall assemblies of any desired size and complexity.

Although the invention has been described in detail for the purpose of illustration, it is to be understood that such detail is solely for that purpose and that variations can be made therein by those skilled in the art without departing from the spirit and scope of the invention as claimed herein.

What is claimed is:

1. An echo chamber for use with a disappearing artificial waterfall, said chamber comprising:

a substantially rigid water sump receptacle having a bottom, side wall means and an open top, said receptacle being constructed to produce an echo sound when water from a disappearing artificial waterfall enters said open top and falls into the receptacle;

weight bearing substantially rigid grate means covering said open top;

structural reinforcement means comprising inwardly projecting protrusions in said side wall means; and grate supporting means comprising (i) ledge means established by said structural reinforcement means and atop which said grate means rests, (ii) at least one support beam for supporting said grate means, and (iii) recesses in said inwardly projecting protrusions for receiving opposite ends of said at least one support beam.

2. The echo chamber of claim 1 wherein said grate means is removably connected to said receptacle.

3. echo chamber of claim 1 wherein said grate means is capable of supporting at least about 50 pounds of material.

4. The echo chamber of claim 3 wherein said grate means is capable of supporting up to at least about 4000 pounds of material.

5. The echo chamber of claim 1 wherein said receptacle is formed from plastic.

6. The echo chamber of claim 1 wherein said grate means is formed from plastic.

7. The echo chamber of claim 1 wherein said grate means is formed from corrosion-resistant metal.

8. The echo chamber of claim 1 wherein said at least one support beam is integral with said grate means.

9. The echo chamber of claim 1 wherein said at least one support beam is separate from said grate means.

* * * * *